United States Patent [19]

Parker

[11] Patent Number: 4,913,462

[45] Date of Patent: Apr. 3, 1990

[54] RECORD KEEPING FOLDER AND METHOD

[76] Inventor: Howard J. Parker, Rte. 4, Box 149, Greenville, Tenn. 37743

[21] Appl. No.: 296,015

[22] Filed: Jan. 12, 1989

[51] Int. Cl.[4] ..... B42D 11/00

[52] U.S. Cl. ..... 281/15.1; 281/21.1; 281/31; 281/38; 281/51; 283/101; 283/81; 283/900; 206/232

[58] Field of Search ..... 281/15.1, 15 R, 21.1, 281/31, 38, 51; 283/81, 101, 66.1, 900; 412/901; 206/232; 40/359

[56] References Cited

U.S. PATENT DOCUMENTS

| | | | |
|---|---|---|---|
| 1,825,845 | 10/1931 | Ainsworth | 283/105 |
| 1,880,549 | 10/1932 | Walker | 40/359 |
| 2,123,903 | 7/1938 | Lane et al. | 281/15.1 |
| 2,184,987 | 12/1939 | Carpenter et al. | 281/51 |
| 3,043,734 | 7/1962 | Porter . | |
| 3,856,332 | 12/1974 | Snedeker | 283/57 |
| 3,870,223 | 3/1975 | Wyant | 281/31 |
| 3,960,634 | 6/1976 | Kempster | 283/81 |
| 4,221,404 | 9/1980 | Shuffstall | 283/117 |
| 4,301,962 | 11/1981 | Monckton | 281/31 |
| 4,422,672 | 12/1983 | Levi | 283/66.1 |
| 4,511,298 | 4/1985 | Jones | 412/48 |
| 4,526,404 | 7/1985 | Vazquez | 283/79 |
| 4,673,324 | 6/1987 | Hanson et al. | 412/901 |
| 4,717,176 | 1/1988 | Matthews | 281/31 |
| 4,789,187 | 12/1988 | Corlew et al. | 281/15.1 |

FOREIGN PATENT DOCUMENTS

| | | | |
|---|---|---|---|
| 204869 | 9/1939 | Switzerland | 40/359 |

*Primary Examiner*—Frank T. Yost

*Assistant Examiner*—Thomas Hamill, Jr.

[57] ABSTRACT

A record keeping folder having a pair of hinged covers, the inner surface of one of the covers being provided with a restraining pocket for holding one or more individual record sheets in a readily removable condition, the inner surface of the other of the covers being essentially unencumbered, each of the record sheets having an adhesive border, and a protective strip covering the adhesive border and being peelable from the adhesive border to allow the border to be adhesively affixed to the other unencumbered cover with the sheet lying substantially flat thereon.

14 Claims, 1 Drawing Sheet

RECORD KEEPING FOLDER AND METHOD

This invention concerns a novel record keeping folder and special record keeping sheets for use therewith, all of which are hereinafter generally referred to as folder, and particularly concerns such folders and their method of use in keeping records over an extended period of time wherein multiple sheets are required with multiple entries thereon, preferably in type and in chronological order.

Typical record keeping devices, or methods of affixing loose sheets to a permanent support, some of which employ adhesive means, are shown in the following U.S. Pat. Nos.: 3,960,634, 3,043,734; 3,856,332; 4,511,298; 4,422,672; 2,510,263; 4,714,276; 2,184,987; 1,880,549; 4,673,324; 4,526,404; and 1,825,845.

These prior devices have utility for the precise purposes for which they are designed, but would not be satisfactory or as effective for applicant's purposes. For example, the master sheet of U.S. Pat. No. 3,960,634 and its method of use in keeping medical records are entirely different from applicant's in that the patented device and method involves the copy machine duplication of a record sheet such that doctor and patient data can be retained by the doctor in anticipation of another visit, and then upon such visit, a stick-on, up-to-date service record sheet is applied over the previous record. There is no folder involved, nor is there any attempt to use the record sheet for multiple entries over an extended period of time. A permanent record therefor, for the doctor, employing this method would consist of a stack of separate, unbound record sheets.

Other conventional record keeping devices or methods involve merely keeping multiple entry record sheets loosely in a folder or by affixing the same to a cover or base or the like with metal bend-over tabs or plastic fingers and retainer or the like, wherein rapid removal and replacement is not possible.

A principal object therefore, of the present invention, is to provide a convenient device for assisting in the preparation and retention of medical records or the like in folder form wherein mechanical means such as clips or fold-over tabs are obviated.

These and other objects hereinafter appearing have been attained in accordance with the present invention through the structure and method of use of a record keeping folder comprising a pair of hinged covers, the inner surface of one of said covers being provided with restraining means for holding one or more individual record sheets in a readily removable condition, the inner surface of the other of said covers being essentially unencumbered, each of said sheets having an adhesive border, and protective means covering said adhesive border, said protective means being peelable from said adhesive border to allow said border to be adhesively affixed to said other unencumbered cover with the sheet lying substantially flat thereon.

In the method embodiment of the present invention the procedure is defined as a method for recording and keeping a permanent record of events, comprising maintaining a folder comprising a pair of hinged covers, the inner surface of one of said covers being provided with restraining means for holding one or more individual record sheets in a readily removable condition, the inner surface of the other of said covers being essentially unencumbered, placing one or more record sheets in said readily removable condition with respect to said restraining means, each of said sheets having an adhesive border and protective means covering said adhesive border, said protective means being peelable from said adhesive border to allow said border to be adhesively affixed to said other unencumbered cover with the sheet lying substantially flat thereon, removing one of said record sheets from said restraining means and making an entry thereon and either replacing said sheet within said restraining means in contemplation of subsequent entries thereon or removing said protective means therefrom and adhesively affixing said sheet to said inner surface the other of said covers.

In certain preferred or related method embodiments:

- a plurality of loose record sheets are maintained within said retention means;
- said retention means comprises a pocket;
- said entries are made by type;
- said record sheets as they are substantially filled with entries, are adhesively affixed one to the other in a stack; and
- the affixation of the sheets are to the left hand margin of the right hand cover.

In certain preferred or related structural embodiments;

- one or more record sheets are retained in position on said one cover;
- said retention means comprises a pocket;
- said record sheets are loosely held in said pocket and wherein said sheets are lined for typing purposes; and
- said adhesive border is on a vertical edge of said sheets.

The invention and further preferred embodiments thereof will be further understood from the following description and drawings wherein.

Figure 1:
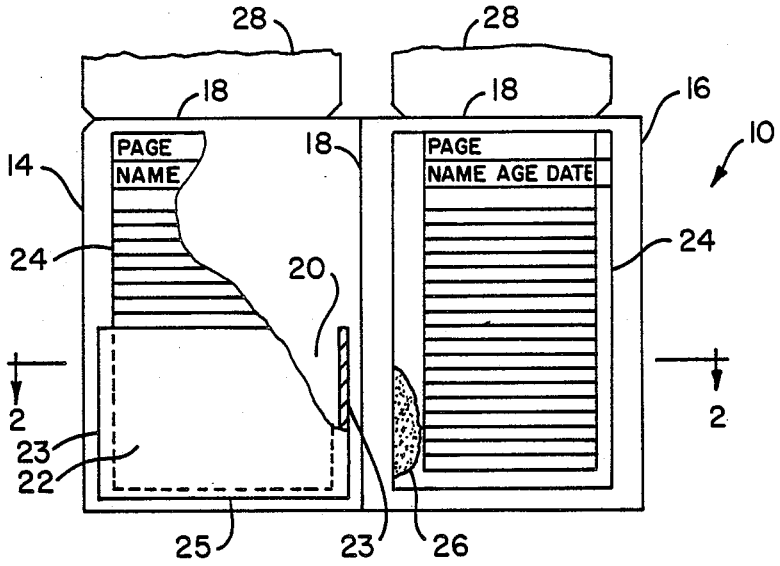
FIG. 1 is an elevational view of a preferred folder in open position with portions of exemplary record sheets thereon.

Referring to the drawings, the folder of the present invention, in the embodiment shown, designated 10 comprises a pair of hinged covers 14 and 16, wherein the hinge 18 is of any conventional type such as typically used for office folders or the like. The folder may be of paperboard, cardboard, plastic, or any convenient material. The left hand cover 14 is provided with a record sheet restraining means which in the embodiment shown comprises a pocket 20 formed from a sheet of material 22 adhesively secured along its sides 23 and bottom 25 to the cover. The height and thickness of the pocket are sufficient to loosely hold several record sheets 24, two of which are shown, in exaggerated thickness, positioned in the pocket. It is noted that these record sheets may be designed for recording any material, however, in the preferred context of the present invention, the sheets are designed to receive typed entries. Alternatively to a pocket, the restraining means may consist of a rubber band or the like slightly stretched and affixed at its ends to the cover and extending thereacross a sufficient length to accommodate the width of the record sheets slid thereunder. Also, a substantially flat clip or the like affixed to the cover and openable to receive the record sheets may be employed.

The record sheets 24 are provided along an edge, preferably the left vertical edge as shown, with an adhesive material 26 of conventional composition and normally covered by a peelable protective strip (not shown). The adhesive may alternatively be placed on other edges, however, the left hand edge allows the sheets to be opened as a book for easy reference.

Figure 2:
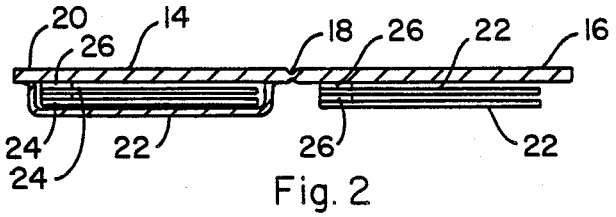
FIG. 2 is a cross-sectional view with thickness dimensions exaggerated for clarity, taken along line 2—2 of FIG. 1 in the direction of the arrows.
Figure 3:
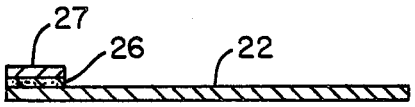
FIG. 3 is an enlarged cross-sectional view of the sheet means of FIG. 2 showing the peelable protective strip for the adhesive border.

The present folder is extremely easy to use as entries are made on the top record sheet retained on cover 14, preferably by typing, and the sheet is then returned to the pocket as the topmost sheet such that it can be quickly removed and reviewed and additional entries made thereon. When a desired number of entries are made on the sheet, the protective strip is peeled off and the sheet affixed to cover 16 or to a previously adhered sheet by pressing the adhering edge thereof against the cover or previous sheet as shown in FIG. 2. It is noted that the positions of the pocket and the filled-up sheets can be reversed on the covers, i.e., the pocket can be placed on cover 16.

In a preferred embodiment, either or both of the covers may be provided with a protective flap 28 which is hinged in a manner such as 18 to the tops of the covers. These flags are swingable downwardly and are of sufficient length to protect the sheets from abuse or dirt or the like. Such flaps may be hinged on the side or bottom edges of the covers as well. It is noted that as for any such record folder, divider or index sheets or the like may be used, such as that shown in U.S. Pat. No. 4,422,672, the disclosure of which is incorporated herein by reference. Also, the folder may be of any convenient shape or size.

The invention has been described in detail with particular reference to preferred embodiments thereof, but it will be understood that variations and modifications will be effected within the spirit and scope of the invention.

I claim:

1. A record keeping portfolio comprising the combination of folder means and one or more record sheet means adapted for loose retention therein or adhesive attachment thereto, said folder means comprising a pair of hinged covers providing a pair of juxtaposed inner surfaces, the inner surface of one of said covers being provided with restraining means for removably holding one or more of said record sheet means on said one cover, the inner surface of the other of said covers being essentially smooth, each of said sheet means having an adhesive border on one side thereof along an edge portion, protective means covering said adhesive border, said protective means being peelable from said adhesive border to allow said sheet means to be adhesively attached to said inner surface of said other cover by pressing said adhesive border thereagainst.

2. The folder of claim 1 wherein said restraining means comprises a pocket and wherein at least one of said sheet means is loosely held within said pocket.

3. The folder of claim 2 wherein said sheet means is lined for typing purposes, and wherein a sheet means is adhesively attached to the inner surface of said other cover.

4. The folder of claim 1 wherein said sheet means is rectangular and the adhesive border is on a long edge portion thereof.

5. The folder of claim 1 wherein said sheet means is rectangular and the adhesive border is on a short edge portion thereof.

6. The folder of claim 1 wherein said one cover is on the left hand side.

7. The folder of claim 6 wherein either or both of said covers are provided at their tops with an upwardly and downwardly swingable hinged protective flap.

8. A method for recording and keeping a permanent record of events, comprising providing a record keeping portfolio having the combination of folder means and one or more record sheet means, said folder means having a pair of hinged covers providing a pair of juxtaposed inner surfaces, the inner surface of one of said covers being provided with restraining means for removably holding said sheet means on said one cover, the inner surface of the other of said covers being substantially smooth, each of said sheet means having an adhesive border on one side along an edge portion thereof, protective means covering said adhesive border and being peelable therefrom to expose the adhesive and allow said sheet means to be adhesively attached to said inner surface of said other cover with said sheet means lying substantially flat thereon, placing one or more of said sheet means within said restraining means, removing a first sheet means from said restraining means and making an entry thereon and either replacing the same within said restraining means in contemplation of making subsequent entries theron, or peeling said protective means from said adhesive border and adhesively attaching said sheet means to said inner surface of said other of said covers by pressing said adhesive border thereagainst.

9. The method of claim 8 wherein said restraining means comprises an upwardly open pocket into which said sheet means are removably inserted.

10. The method of claim 8 wherein each sheet means which is used subsequent to adhesively attaching said first sheet means to said other cover is adhesively attached to the said first sheet means by pressing the exposed adhesive border therof against an upper exposed portion of the said first sheet means.

11. The method of claim 10 wherein the said upper exposed portion of each underlying preceding attached sheet means is located substantially directly over the adhesive border thereof but on the opposite side of the sheet means.

12. The method of claim 8 wherein a plurality of loose record sheets are maintained within said restraining means.

13. The method of claim 8 wherein said entries are made by typewriter.

14. The method of claim 8 wherein the affixation of the sheet means is affixed adjacent the left hand margin of the right hand cover.

* * * * *